United States Patent [19]

Neri

[11] 4,227,397

[45] Oct. 14, 1980

[54] METHOD FOR TESTING CIGARETTES

[75] Inventor: Bruno Neri, Bologna, Italy

[73] Assignee: Cir S.p.A. Divisione Sasib, Bologna, Italy

[21] Appl. No.: 20,726

[22] Filed: Mar. 15, 1979

[30] Foreign Application Priority Data

Mar. 22, 1978 [IT] Italy ..... 12526A/78

[51] Int. Cl.[3] ..... G01N 15/08

[52] U.S. Cl. ..... 73/38

[58] Field of Search ..... 73/38, 41, 45, 45.1, 73/45.2

[56] References Cited

U.S. PATENT DOCUMENTS

| | | | |
|---|---|---|---|
| 3,339,402 | 9/1967 | Rudszinat | 73/41 |
| 3,395,570 | 8/1968 | Kochalski | 73/45.2 |
| 3,690,149 | 9/1972 | Pezzi | 73/38 |
| 3,935,728 | 2/1976 | Doerman | 73/41 |
| 3,943,752 | 3/1976 | Doerman et al. | 73/41 |
| 3,991,605 | 11/1976 | Reuland | 73/38 |
| 4,018,081 | 4/1977 | Loxham | 73/41 |

*Primary Examiner*—Gerald Goldberg
*Assistant Examiner*—Joseph W. Roskos
*Attorney, Agent, or Firm*—Spencer & Kaye

[57] ABSTRACT

The method for the electropneumatical testing of the composite wrapper of filter cirgarettes by applying a controlled-flow gas pressure to a cigarette end, comprises a first testing in order to determine the gas permeability of the cigarette along its longitudinal direction, i.e. the gas permeability of the filter and of the tobacco filler, in which the cigarette end opposed to the end to which the gas pressure is applied is maintained open and the outer surface of the tipping band is sealed in a gas tight manner; a second testing in order to determine the gas permeability of the paper wrapper which envelopes the tobacco filler, in which the cigarette end opposed to the end to which the gas pressure is applied is closed in gas tight manner, and the outer surface of the tipping band is sealed in a gas tight manner; a third testing in order to determine the gas permeability of the whole composite wrapper in which the cigarette end opposed to the end to which the gas pressure is applied is closed in a gas tight manner. The signals obtained as a result of the second and third testing are compared with respective levels of acceptability presenting a determined value beyond which a cigarette is not acceptable. The value of acceptability is determined for the second testing as a function of the signal obtained from the first testing, and for the third testing as a function of the signals obtained from the first and second testing.

3 Claims, 3 Drawing Figures

9
9
8
TM
TM
S
S
10
III
III
11
B
7
6

METHOD FOR TESTING CIGARETTES

BACKGROUND OF THE INVENTION

This invention has for its object a method for inspecting the integrity of the filter tip cigarette wrapper, that is for detecting and indicating, cigarette by cigarette, the defects of the wrapper. These defects comprise substantially leaks, breaks and paper wrapper sealing discontinuities, or apertues, breaks in the tipping band which attaches the filter plug to the cigarette, as well as wrapping and sealing defects of the said tipping band.

In known electropneumatic cigarette inspection devices, all the defects resulting from leaks in the cigarette wrapper are totally detected, with a single test consisting in applying a calibrated pressure or vacuum at one end of the cigarette while the other end is kept closed by a rubber pad, and in detecting, after a reasonable interval of time, the pressure drop which reveals undue air losses through the wrapper.

This drop, which is applied to known electropneumatic transducers, generates correlative inspection signals which, read with a time scanning procedure and opportunely stored, will be subsequently used to control a device which rejects the defective cigarettes.

This electropneumatic inspection constitutes, however, a principle of selection which has only a first approximation validity. In fact, it cannot take into account the permeability proper of the type of filter and of the cut tobacco, the degree of condensation of which in the rod varies generally within large limits in a random manner; neither can it take into account the fact that the wrapper and the filter tipping material, even if integral, presents already a natural permeability to the air, which generally varies from one cigarette to another, and this variability masks the presence of air loss defects which it would be desired to detect, because it is summed up with them during the test.

SUMMARY OF THE INVENTION

The object of this invention is to submit each cigarette not to a single total test, but to a plurality of distinct tests, whose results, appropriately compared and arranged, give a total indication of the actual cigarette level of acceptability, as regards the cigarette wrapper conditions of integrity.

For this purpose, this invention proposes a testing method for the electropneumatic pressure-drop inspection of the integrity of the filter tip cigarette wrapper, according to which each cigarette to be inspected is sequentially subjected to a coordinated group of three tests, in which the first test provides a signal substantially correlated with the longitudinal permeability of the filter and tobacco filler; the second test provides an indicative signal of the air losses through the paper wrapper of the tobacco filler; while the third test provides an indicative signal of the air losses through the whole wrapper, including the filter tipping band and the respective area of sealing to the paper, and signals obtained with the second and third test, relating respectively to the air losses through the paper and the tipping band being compared with respective acceptability levels, the acceptability level for the signal obtained in the second test being predetermined a function of the longitudinal permeability, of the filter and tobacco filler, indicated by the signal obtained with the first test, and the acceptability level for the signal obtained in the third test being a function of the said permeability in association with the permeability of the paper, given by the second test, from these comparisons there being generated, if necessary, the inspection signals for the rejection of the defective cigarettes which have given rise to them.

The above and other features and advantages of the testing method according to the invention will appear evident from the following detailed description of a preferred embodiment, made with reference to the attached sheets of drawings.

DESCRIPTION OF THE PREFERRED EMBODIMENT

With reference to the drawings the method according to the invention is characterized by the succession of the following three tests, to which each of the cigarettes S to be inspected is submitted, for rejection of those cigarettes presenting defects resulting from leakages through the wrapper components, that is, wound paper C, which envelopes the tobacco filler, filter F, and tipping band T which attaches filter F to paper C.

Figure 1:
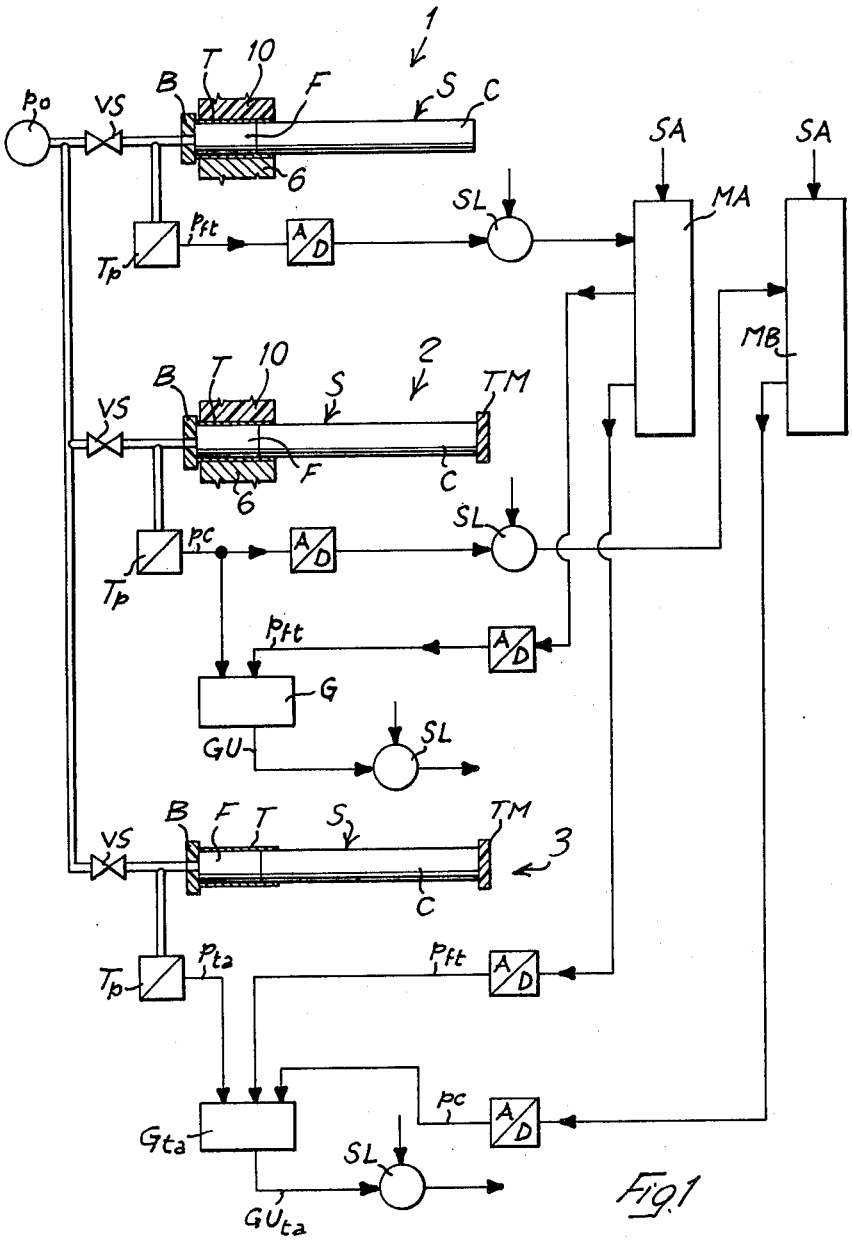
FIG. 1 is a sequential block diagram, which shows the sequence of the test method according to the invention.

In the first of the above mentioned three tests, which is made in the testing station indicated with reference 1 in FIG. 1, to the cigarette S engaged at one end (usually at the filter end) in a mouthpiece B, pressure is applied by means of the mouthpiece from a constant pressure generator $p_o$ through a reduction valve VS while the other cigarette end is left not obstructed in order to permit the air which has passed through the cigarette to flow freely into the atmosphere. Furthermore, in this test, the surface of tipping band T, including the junction area between the tipping band and the paper, is completely sealed. A pressure transducer Tp is connected with mouthpiece B, that is between valve VS and a cigarette filter F engaged in that mouthpiece and responds to the actual value of the pressure, which is reached during each test, supplying as an output an electric signal $p_{ft}$, whose level is essentially in relation to the longitudinal permeability of the filter and tobacco filler and, to a small extent, also to air losses through paper C. Obviously, in this case, the exact indication of $p_{ft}$ should be obtained by sealing the surface of paper C, in addition to that of tipping band T. However, in general, it is preferred to not seal the paper wrapper C, in favour of a greater constructive and operating simplicity of the testing since, practically, signal $p_{ft}$ gives a sufficiently approximate value of the longitudinal permeability of the filter and tobacco filler.

Signal $p_{ft}$ so obtained in this first test, is read at the time determined by the electric reading indicator, or "strobe", which scans rhythmically the successive instants in which the data, supplied by the pressure transducer Tp relating to each of the three tests, must be read. This signal is stored in storage MA, after codification in an analogue/digital converter, which makes it suitable to be stored in numerical binary terms. This is necessary because storage MA is organized as a shift register, so that each datum $p_{ft}$ is brought forward in the storage in synchronism with the actual forward movement of the cigarettes in the mechanical support which conveys them, in such a way as to correlate each group of three data, and the rejection signals resulting from them, with the tested cigarettes to which these signals correspond.

In the second test, which is indicated with reference 2 in FIG. 1 and which can be made at the same station as the previous test 1, or in another testing station of the device, the conditions of test 1 are repeated, with the addition of rubber pad TM which closes the free end of cigarette S being tested. Under these conditions, pressure transducer Tp, at the reading time scanned by strobe SL, emits as output an electric signal $p_c$ which gives a prevailing indication of the permeability of the paper C influenced in a secondary manner by the longitudinal permeability of filter and tobacco filler.

Now, according to a main feature of the method according to this invention, the value of this filter-tobacco filler permeability $p_{ft}$ for the same cigarette had already been determined beforehand and stored in the above described first test. Consequently, since signal $p_c$ must be compared with a level of acceptability of the cigarette as regards the state of integrity of the paper wrapper, this level of comparison will no longer have to be constituted by a preset average value, always subjected to inevitable uncertainties of approximation due to the variability of the cigarette parameters, but could be more exactly configured and calculated as a function of signal $p_{ft}$. In fact, since the fluidic resistances of the filters, of the tobacco and of the paper are physically summed up between each other, when the value of $p_{ft}$ increases also the level of the signal of acceptability to be compared with signal $p_c$, indicative of the state of integrity of the paper C will have to be adequately increased. This dependence of $p_c$ on $p_{ft}$ is not linear, but is somewhat more complex and at any rate requires in each case an experimental calibration, according to the type and the characteristics of the cigarettes being examined.

The value of $p_c$ determined with this second test is stored in shift register MB, with the same procedure already described for $p_{ft}$ determined with the first test. The scanning device or strobe SA determine the times of advancement of the data stored in shift registers MA and MB.

The comparison between $p_c$ and $p_{ft}$ is made in threshold circuit G, which calls $p_{ft}$ from storage MA through digital/analogue recoder D/A. Based on the result of this comparison, a rejection signal is emitted at output GU of threshold circuit G, at the time scanned by strobe SL. This scanning ensures that the rejection will involve exactly the cigarette which has produced the signal. In any event, signal $p_c$, appropriately decoded in A/D will remain stored in MB for the subsequent third test of the cigarette. This third test is made with the same modalities as the second and, obviously, on the same cigarette, with the difference that now also the surface of the tipping band T is left uncovered.

The purpose of this test is to arrive at a satisfactory evaluation of permeability $p_{ta}$ of the tipping band T and of the area where same is sealed to the paper wrapper. Now, such a direct evaluation is not, however, practically possible, because this would require the sealing of the paper wrapper surface, which obviously involves excessive manufacturing complications, so that the signal $p_{ta}$ coming out of the corresponding transducer $T_P$, includes also the effects of the permeability of the other components, namely the filter, the tobacco filler and the paper wrapper.

However, if the values, measured and stored, $p_{ft}$ and $p_c$, which correspond respectively to the longitudinal filter-tobacco permeability and to the paper permeability, are taken into account, it can be understood that, from signal $p_{ta}$ emitted by the coresponding transducer $T_p$, it is actually possible to obtain a prevailing indication of the permeability of the tipping band T.

For this purpose, in the testing station 3 signal $p_{ta}$ obtained with the third test is compared with a level of acceptability which is a function of $p_{ft}$ and $p_c$. The comparison is made in the three-input threshold circuit $G_{ta}$. To one of these inputs there is applied $p_{ta}$, while levels $p_{ft}$ and $p_c$ called from MA and MB through reverse coders D/A are applied to the other two inputs.

In this comparison, the direction of the correlation between levels and signals is such that the level of acceptability of $p_{ta}$ increases with the increase of $p_{ft}$ and $p_c$; while the shape and the degree of the correlation vary experimentally.

If signal $p_{ta}$ is lower than the level of acceptability, there will be emitted at the output $GU_{ta}$ a correlative rejection signal. The excessive permeability of the tipping band T is indicative of air losses, due to the presence of defects in this area.

The main advantage of the above described testing method consists in the fact that the decision of rejection, for each single type of defect, is operated by taking into account the actual value of porosity, or permeability to the gas, of some typical components of the cigarettes being examined, obtained from a series of successive tests on that cigarette. This, unlike other conventional methods, in which the decision of rejection is effected by simply taking into account the average porosity values of all the cigarette components.

Consequently, the method according to this invention allows to elimination, at least partly, of the difficulty represented by the degree of variability of the porosity of the elements composing the cigarette, because the porosity of some of these elements is tested previously on the same cigarette being examined. In fact, a single measurement performed on the cigarette with the purpose of evaluating the porosity or permeability to the air of its components, could never be physically conditioned by the porosity of only one of the components, unless paper, tobacco, tipping band and filter are separated from each other, but will always be conditioned by the group of some components of the cigarette.

In view of the above, if it is desired to decide on the acceptability of a cigarette, as regards the integrity of its wrapper and on the basis of the data of only one test, the degree of variability of the porosity of all the components which cooperate in the determination of the magnitude of the measurements made would have to be taken into account.

If, on the other hand, a previous test has been made on the same cigarette, through which there has been obtained the actual value of porosity of some components which individually resulted to be within the limits of acceptability, then, in evaluating the datum of the second test, that is, of the total one, it will be possible to utilize the actual value of these components as a basic standard for the comparison of acceptability without making recourse to the comparison with supposed average values, always affected by a certain degree of variability.

A device for the realization of the above described method is of the type generically described in the U.S. Pat. No. 3,690,149 (PEZZI) from which it differs on account of some changes which are necessary in order to conduct the three correlated tests.

Figure 2:
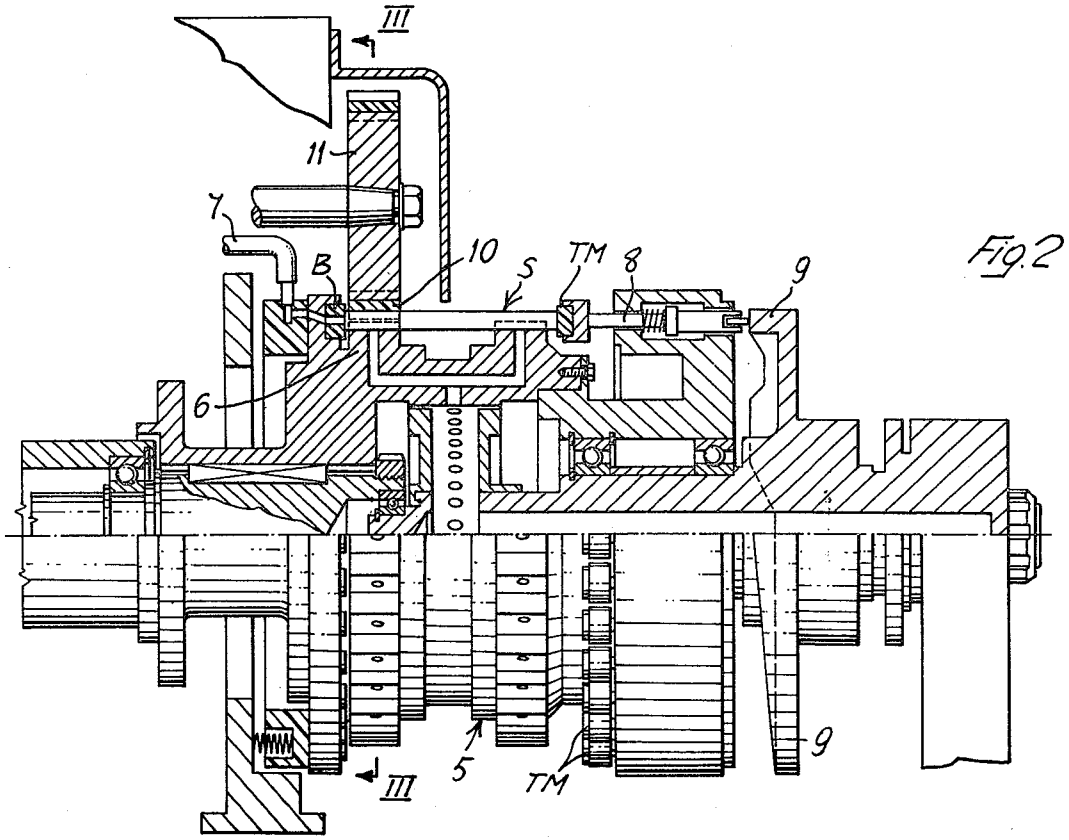
FIG. 2 is a partly sectioned elevation of a cigarette handling device, which has the function of cigarette handling support for effecting the testing method shown in FIG. 1.
Figure 3:
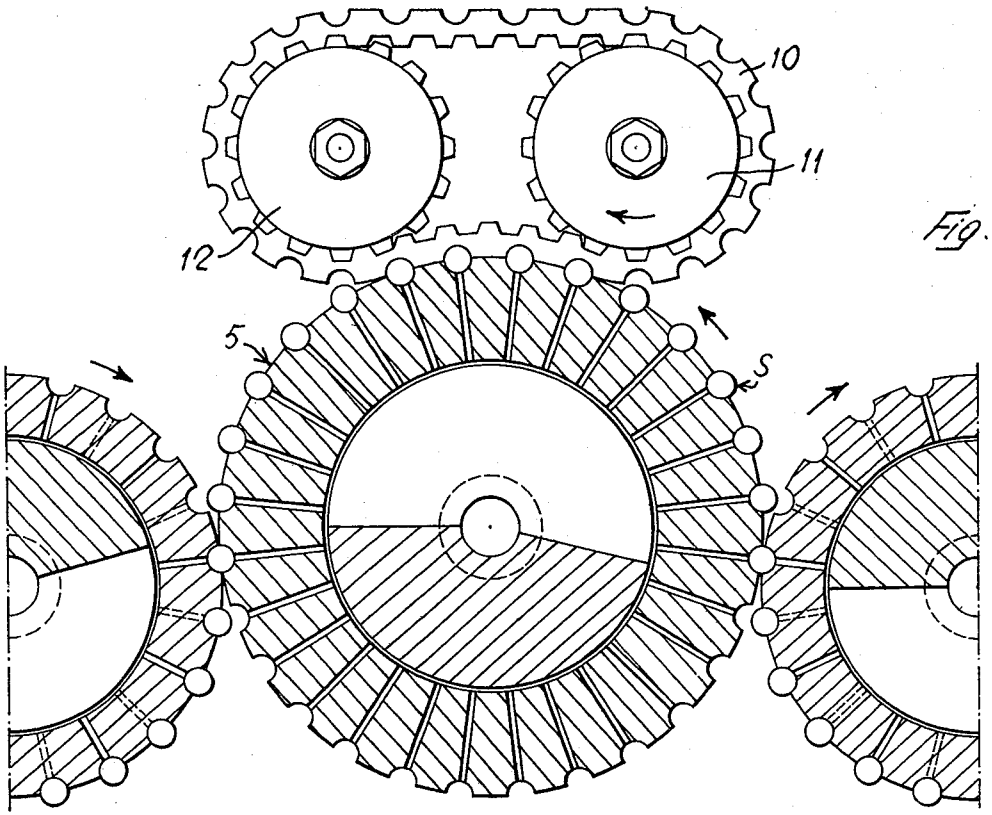
FIG. 3 is a diagrammatic section taken on lines III—III of FIG. 2.

The testing device shown in FIGS. 2 and 3, presents, as a support for the forward movement of the cigarettes S being tested, a fluted wheel 5 provided with suction flutes. The mouthpieces B are arranged in an annular member 6 integral with wheel 5 and are periodically set to communicate with the pressurized and controlled air delivery tube 7. Rubber pad TM, which closes in due time the free end of cigarette S in tests 2 and 3 is carried at the end of a spring rod 8 which cooperates with a profile of a front cam 9 in such a way as to cause the pad to move in due time against the cigarette end.

In order to seal the surface of tipping band T of the cigarette, in the moments in which this sealing is required by the test, there is provided an endless fluted tape 10, driven on pulleys 11 and 12, in synchronism and time relationship with the rotation of wheel 5, as shown in FIG. 3. This tape 10 is made of soft and air tight material.

Cam 9 has such a profile that spring plungers 8 carrying rubber pads TM, after having caused the ends of filters F of the cigarette being tested to come into contact with the mouthpieces B, will move back to allow the first test, which does not require the closure of the cigarette free end with rubber pad TM. Subsequently, rubber pad TM is caused to move forward again against the cigarette end, this being required for the effectuation of the second and third tests, in which the cigarette end must be closed.

I claim:

1. In a method for the electropneumatical testing of the composite wrapper of filter cigarettes, said composite wrapper consisting of a paper wrapper surrounding a tobacco filler and a tipping band surrounding a filter plug and attaching the said filter plug to the said paper wrapper, which method includes applying a controlled-flow gas pressure to one end of each cigarette, the improvement wherein said method further comprises subjecting each cigarette, individually, to:

(a) a first testing in order to determine the gas permeability of the cigarette along its longitudinal direction, i.e. the gas permeability of the filter and of the tobacco filler, said first testing comprising maintaining the cigarette end opposed to the end to which the gas pressure is applied open, maintaining the outer surface of the tipping band sealed in a gas tight manner, and deriving a first testing signal representative of the resulting gas pressure applied to the cigarette;

(b) a second testing in order to determine the gas permeability of the paper wrapper which envelopes the tobacco filler, said second testing comprising maintaining the cigarette end opposed to the end to which the gas pressure is applied is closed in a gas tight manner, maintaining the outer surface of the tipping band sealed in a gas tight manner, and deriving a second testing signal representative of the resulting gas pressure applied to the cigarette;

(c) a third testing in order to determine the gas permeability of the whole composite wrapper, said third testing comprising maintaining the cigarette end opposed to the end to which the gas pressure is applied closed in a gas tight manner, and deriving a third testing signal representative of the resulting gas pressure applied to the cigarette, and comparing the second and third testing signal with respective levels of acceptability each presenting a determined value beyond which a cigarette is not acceptable, said value of acceptability being determined for the second testing signal as a function of the value of the first testing signal, and for the third testing signal as a function of the values of the first and second testing signals.

2. A method according to claim 1, said which in first testing also comprises maintaining the outer surface of the paper wrapper sealed in a gas tight manner.

3. A method according to claims 1 or 2, in which in said third testing also comprises maintaining the outer surface of the paper wrapper sealed in a gas tight manner.

* * * * *